US010602276B1

(12) United States Patent
Kirsch

(10) Patent No.: US 10,602,276 B1
(45) Date of Patent: Mar. 24, 2020

(54) INTELLIGENT PERSONAL ASSISTANT

(71) Applicant: HARMAN INTERNATIONAL INDUSTRIES, INCORPORATED, Stamford, CT (US)

(72) Inventor: James M. Kirsch, Salt Lake City, UT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/269,110

(22) Filed: Feb. 6, 2019

(51) Int. Cl.

| | |
|---|---|
| ***H04R 5/04*** | (2006.01) |
| ***G10L 21/0216*** | (2013.01) |
| ***H04R 5/027*** | (2006.01) |
| ***H04R 3/04*** | (2006.01) |
| *G10L 21/0208* | (2013.01) |

(52) U.S. Cl.
CPC ..... *H04R 5/04* (2013.01); *G10L 21/0216* (2013.01); *H04R 3/04* (2013.01); *H04R 5/027* (2013.01); *G10L 2021/02082* (2013.01)

(58) Field of Classification Search
CPC ..... G10L 2021/02082; G10L 21/0216; H04R 5/04; H04R 3/04; H04R 5/027
See application file for complete search history.

(56) References Cited

U.S. PATENT DOCUMENTS

| | | | | |
|---|---|---|---|---|
| 10,311,871 | B2 * | 6/2019 | Newendorp | G10L 15/32 |
| 2018/0301147 | A1 * | 10/2018 | Kim | G10L 15/22 |
| 2019/0074991 | A1 * | 3/2019 | Peterson | G06F 3/167 |
| 2019/0141449 | A1 * | 5/2019 | Barjatia | H04S 7/301 |
| 2019/0196779 | A1 * | 6/2019 | Declerck | G06F 3/167 |

* cited by examiner

*Primary Examiner* — Regina N Holder
(74) *Attorney, Agent, or Firm* — Brooks Kushman, P.C.

(57) ABSTRACT

A personal assistant device may include a microphone configured to receive an audio command from a user and a processor. The processor may be configured to receive a microphone output signal from the microphone based on the received audio command, receive at least one other microphone output signal from another personal assistant device, and autocorrelate the microphone output signals. The processor may also be configured to determine a reverberation of each of the microphone output signals, determine whether the microphone output signal from the microphone has a lower reverberation than the at least one other microphone output signal, and transmit the microphone output signal to at least one other processor for processing of the audio command in response to the microphone output signal having a lower reverberation than the at least one other microphone output signal.

20 Claims, 6 Drawing Sheets

INTELLIGENT PERSONAL ASSISTANT

TECHNICAL FIELD

Aspects of the disclosure generally relate to an intelligent personal assistant.

BACKGROUND

Personal assistant devices such as voice agent devices are becoming increasingly popular. These devices may include voice controlled personal assistants that implement artificial intelligence based on user audio commands. Some examples of voice agent devices may include Amazon Echo, Amazon Dot, Google At Home, etc. Such voice agents may use voice commands as the main interface with processors of the same. The audio commands may be received at a microphone within the device. The audio commands may then be transmitted to the processor for implementation of the command.

SUMMARY

A personal assistant device may include a microphone configured to receive an audio command from a user and a processor. The processor may be configured to receive a microphone output signal from the microphone based on the received audio command, receive at least one other microphone output signal from another personal assistant device, and autocorrelate the microphone output signals. The processor may also be configured to determine a reverberation of each of the microphone output signals, determine whether the microphone output signal from the microphone has a lower reverberation than the at least one other microphone output signal, and transmit the microphone output signal to at least one other processor for processing of the audio command in response to the microphone output signal having a lower reverberation than the at least one other microphone output signal.

A personal assistant device system may include a plurality of personal assistant devices, each including a microphone configured to receive an audible user command and a processor configured to receive at least one microphone output signals based on the user command from each of the personal assistant devices, autocorrelate the microphone output signals, determine a reverberation of each of the microphone output signals, and determine which of the microphone output signals has the lowest reverberation; and process the microphone output signal having the lowest reverberation.

A method may include receiving a microphone output signal from a microphone of a personal assistant device based on a received audio command, receiving at least one other microphone output signal from another personal assistant device, autocorrelating the microphone output signals, determining a reverberation of each of the microphone output signals, and determining whether the microphone output signal from the microphone has a lower reverberation than the at least one other microphone output signal, and transmitting the microphone output signal to at least one other processor for processing of the audio command in response to the microphone output signal having a lower reverberation than the at least one other microphone output signal.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
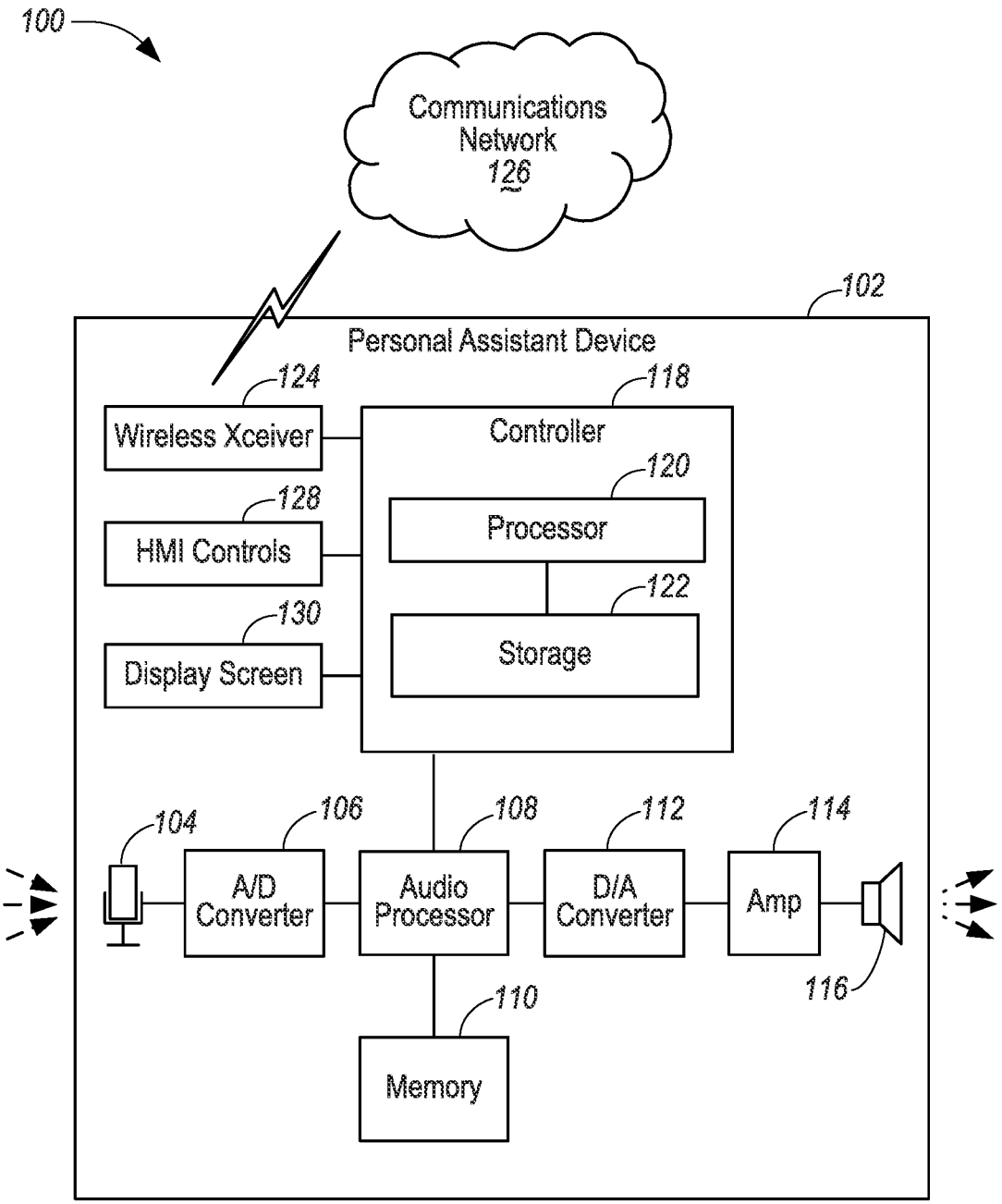
FIG. 1 illustrates a system including an example intelligent personal assistant device, in accordance with one or more embodiments.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Personal assistant devices may include voice controlled personal assistants that implement artificial intelligence based on user audio commands. Some examples of voice agent devices may include Amazon Echo, Amazon Dot, Google At Home, etc. Such voice agents may use voice commands as the main interface with processors of the same. The audio commands may be received at a microphone within the device. The audio commands may then be transmitted to the processor for implementation of the command. In some examples, the audio commands may be transmitted externally, to a cloud based processor, such as those used by Amazon Echo, Amazon Dot, Google At Home, etc.

Often, a single home, or even a single room, may include more than one personal assistant device. For example, an area or room may include a personal assistant device located each corner. Further, a home may include a personal assistant device in each of the kitchen, bedroom, home office, etc. The personal assistant devices may also be portable and may be moved from room to room within a home. Because of the close proximity of these devices, more than one device may "hear" or receive user commands.

In a home with multiple voice agent devices, each may be able to respond to the user. If this is the case, multiple responses to the user command may overlap, causing the sound to be cluttered, duplicative processing and bandwidth used, or performing an action more than once (e.g., ordering a product form an online distributor).

Voice commands may be received via audio signals at the microphone of the voice agents. Typically, as a sound source (e.g., the user command) and a microphone get farther apart, the strength of the received sound wave is reduced due to spherical spreading. This may be known as "$R^2$ loss" or "20 log R" loss. Further, the high frequencies may be absorbed more so than low frequencies, the extent to which may depend on air temperature and humidity. The command, or audio signal, may also be received later in time, equal to the propagation time of the sound wave. Finally, the reflections may be detected in the signal from the microphone. These reflections, such as the room impulse response (RIR) may be used to determine a relative distance between the user and the microphone.

Current systems that measure the quality of microphones may be inaccurate as the signal may be misled by local environmental noise sources. The high frequency content may be noise generated by the microphone itself, especially if speech has been attenuated due to distance. The timing of the sound receptions may require synchronized time clocked across a plurality of microphone systems.

Disclosed herein is a system for determining which microphone of a plurality of microphones receives the highest quality acoustic signal. The microphone that receives the highest quality signal may be likely to yield the most accurate speech recognition, and therefore, provide the most accurate response to the user. To determine which microphone has the highest quality, the room impulse response (RIR) may be used. When comparing the RIR across multiple microphones, the microphone with the shortest RIR (i.e., receives the energy the soonest), may be determined to have the highest quality. Current methods to determine the RIR may include kernel regression, recurrent neural networks, polynomial roots, orthonormal basis function (Principal Component Analysis), and iterative blind estimation.

However, a simpler method may include inferring reverberation via autocorrelation. This method looks for repetitions within a signal. Since echoes and reverberation are effectively repetitions in the sound wave, the energy spread within an autocorrelation vector i.e. the deviations from the center peak, may indicate the amount of reverberation, as well as the amount of noise.

Thus, the microphone associated with the personal assistant device with the highest quality may be identified based on comparing the reverberations of the other microphones. The microphone with the lowest reverberations may be selected to handle the user command and respond thereto.

FIG. 1 illustrates a system 100 including an example intelligent personal assistant device 102. The personal assistant device 102 receives audio through a microphone 104 or other audio input, and passes the audio through an analog to digital (A/D) converter 106 to be identified or otherwise processed by an audio processor 108. The audio processor 108 also generates speech or other audio output, which may be passed through a digital to analog (D/A) converter 112 and amplifier 114 for reproduction by one or more loudspeakers 116. The personal assistant device 102 also includes a device controller 118 connected to the audio processor 108.

The device controller 118 also interfaces with a wireless transceiver 124 to facilitate communication of the personal assistant device 102 with a communications network 126 over a wireless network. The personal assistant device 102 may also communicate with other devices, including other personal assistant devices 102 over the wireless network as well. In many examples, the device controller 118 also is connected to one or more Human Machine Interface (HMI) controls 128 to receive user input, as well as a display screen 130 to provide visual output. It should be noted that the illustrated system 100 is merely an example, and more, fewer, and/or differently located elements may be used.

The A/D converter 106 receives audio input signals from the microphone 104. The A/D converter 106 converts the received signals from an analog format into a digital signal in a digital format for further processing by the audio processor 108.

While only one is shown, one or more audio processors 108 may be included in the personal assistant device 102. The audio processors 108 may be one or more computing devices capable of processing audio and/or video signals, such as a computer processor, microprocessor, a digital signal processor, or any other device, series of devices or other mechanisms capable of performing logical operations. The audio processors 108 may operate in association with a memory 110 to execute instructions stored in the memory 110. The instructions may be in the form of software, firmware, computer code, or some combination thereof, and when executed by the audio processors 108 may provide the audio recognition and audio generation functionality of the personal assistant device 102. The instructions may further provide for audio cleanup (e.g., noise reduction, filtering, etc.) prior to the recognition processing of the received audio. The memory 110 may be any form of one or more data storage devices, such as volatile memory, non-volatile memory, electronic memory, magnetic memory, optical memory, or any other form of data storage device. In addition to instructions, operational parameters and data may also be stored in the memory 110, such as a phonemic vocabulary for the creation of speech from textual data.

The D/A converter 112 receives the digital output signal from the audio processor 108 and converts it from a digital format to an output signal in an analog format. The output signal may then be made available for use by the amplifier 114 or other analog components for further processing.

The amplifier 114 may be any circuit or standalone device that receives audio input signals of relatively small magnitude, and outputs similar audio signals of relatively larger magnitude. Audio input signals may be received by the amplifier 114 and output on one or more connections to the loudspeakers 116. In addition to amplification of the amplitude of the audio signals, the amplifier 114 may also include signal processing capability to shift phase, adjust frequency equalization, adjust delay or perform any other form of manipulation or adjustment of the audio signals in preparation for being provided to the loudspeakers 116. For instance, the loudspeakers 116 can be the primary medium of instruction when the device 102 has no display screen 130 or the user desires interaction that does not involve looking at the device. The signal processing functionality may additionally or alternately occur within the domain of the audio processor 108. Also, the amplifier 114 may include capability to adjust volume, balance and/or fade of the audio signals provided to the loudspeakers 116.

In an alternative example, the amplifier 114 may be omitted, such as when the loudspeakers 116 are in the form of a set of headphones, or when the audio output channels serve as the inputs to another audio device, such as an audio storage device or a further audio processor device. In still other examples, the loudspeakers 116 may include the amplifier 114, such that the loudspeakers 116 are self-powered.

The loudspeakers 116 may be of various sizes and may operate over various ranges of frequencies. Each of the loudspeakers 116 may include a single transducer, or in other cases multiple transducers. The loudspeakers 116 may also be operated in different frequency ranges such as a subwoofer, a woofer, a midrange and a tweeter. Multiple loudspeakers 116 may be included in the personal assistant device 102.

The device controller 118 may include various types of computing apparatus in support of performance of the functions of the personal assist device 102 described herein. In an example, the device controller 118 may include one or more processors 120 configured to execute computer instructions, and a storage medium 122 (or storage 122) on which the computer-executable instructions and/or data may be maintained. A computer-readable storage medium (also referred to as a processor-readable medium or storage 122) includes any non-transitory (e.g., tangible) medium that participates in providing data (e.g., instructions) that may be read by a computer (e.g., by the processor(s) 120). In general, a processor 120 receives instructions and/or data, e.g., from the storage 122, etc., to a memory and executes the instructions using the data, thereby performing one or more processes, including one or more of the processes described herein. Computer-executable instructions may be compiled or interpreted from computer programs created using a variety of programming languages and/or technologies including, without limitation, and either alone or in combination, Java, C, C++, C#, Assembly, Fortran, Pascal, Visual Basic, Python, Java Script, Perl, PL/SQL, etc.

While the processes and methods described herein are described as being performed by the processor 120, the processor 120 may be located within a cloud, another server, another one of the devices 102, etc.

As shown, the device controller 118 may include a wireless transceiver 124 or other network hardware configured to facilitate communication between the device controller 118 and other networked devices over the communications network 126. As one possibility, the wireless transceiver 124 may be a cellular network transceiver configured to communicate data over a cellular telephone network. As another possibility, the wireless transceiver 124 may be a Wi-Fi transceiver configured to connect to a local-area wireless network to access the communications network 126.

The device controller 118 may receive input from human machine interface (HMI) controls 128 to provide for user interaction with personal assistant device 102. For instance, the device controller 118 may interface with one or more buttons or other HMI controls 128 configured to invoke functions of the device controller 118. The device controller 118 may also drive or otherwise communicate with one or more displays 130 configured to provide visual output to users, e.g., by way of a video controller. In some cases, the display 130 (also referred to herein as the display screen 130) may be a touch screen further configured to receive user touch input via the video controller, while in other cases the display 130 may be a display only, without touch input capabilities.

Figure 2:
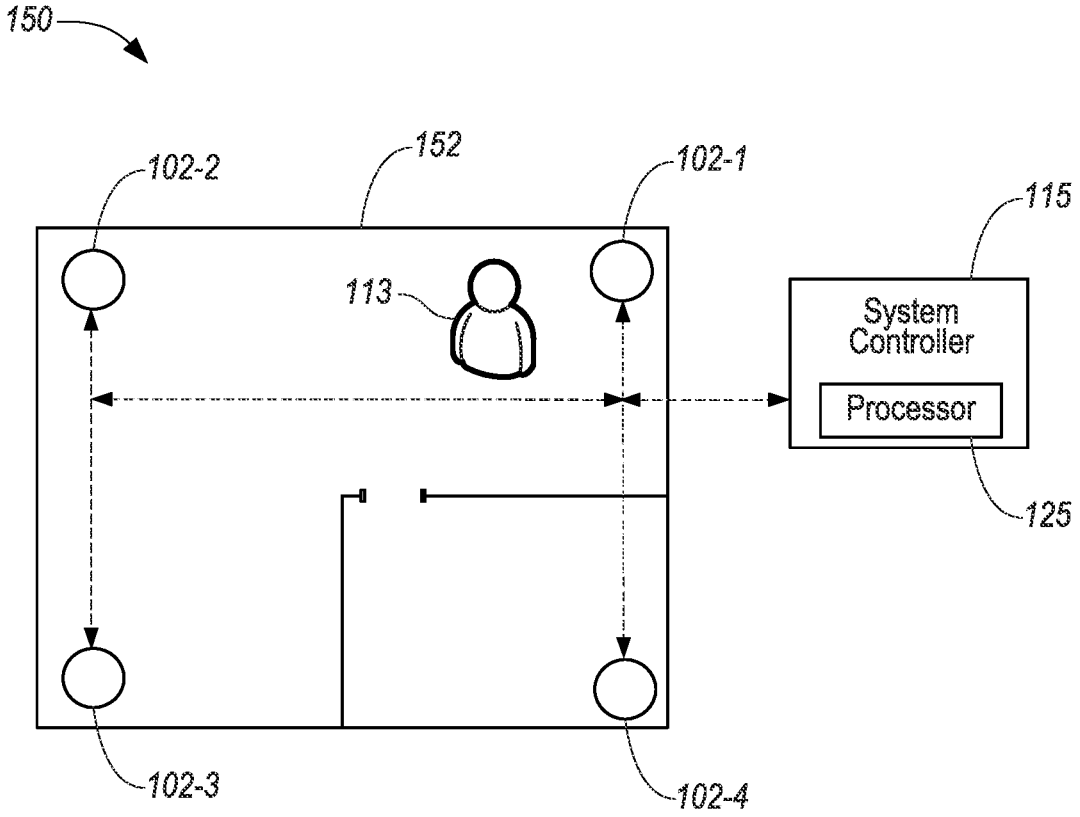
FIG. 2 illustrates a system of a plurality of intelligent personal assistant devices in accordance with one embodiment.

FIG. 2 illustrates a system 150 of a plurality of intelligent personal assistant devices 102-1, 102-2, 102-3, 102-4 (collectively referred to as "assistant devices 102"). Each of the devices 102 may be in communication with one another via the wireless network. The devices 102 may transmit and receive signals and data therebetween via each of their respective wireless transceivers 124. In one example, audio input received at each of the microphones 104 of the devices 102 may be transmitted to each of the other device 102 for comparative processing. This is described in more detail below.

The devices 102 may be arranged within an area 152, such as a room of house, or across multiple rooms, or a single room divided by partitions such as walls, cubicles, etc. The surfaces and objects surrounding the assistant devices 102 may reflect sound waves and cause reverberation. Each device 102 may be of variable distances form a user 113. The example in FIG. 2 illustrates the first device 102-1 being in closest proximity to the user 113, followed by the second device 102-2, and then the third device 102-3. The fourth device 102-4 is the farthest from the user 113 and is arranged around a corner and within a room separate from the user.

As explained with respect to FIG. 1, each assistant device 102 may include a microphone 104 configured to receive audio input, such as voice commands. Further, standalone microphones may also be used in place of the assistant devices 102 to receive audio input. The microphones 104 may acquire audio input or acoustic signals within the area 152. Such audio inputs may control various devices such as lights, audio outputs via the speaker 116 of the assistant device, entertainment systems, environmental controls, shopping, etc. While FIG. 2 illustrates four assistant devices 102, more or less may be used with the system 150.

The assistant devices 102 may be in communication with a system controller 115. The system controller 115 may be a standalone controller, or the controller may be device controller 118 as discussed above with respect to FIG. 1 The system controller 115 may be in communication with the assistant devices 102 via the wireless network. The system controller 115 may be arranged in the same area 152, or external and remote to the area 152, for example, in a cloud. The system controller 115 may be configured to receive the audio inputs from the microphones 104. The system controller 115 may include a processor 125 configured to process the audio inputs. The audio inputs, as explained, may include user commands such as "turn on the light," "play country music," "what is the weather today," etc.

The processor 125 may be a digital signal processor (DSP) to processes the multiple digital signals from the microphones 104 within the area 152. The signals received may be stored in a memory (not shown) associated with the processor 125, or in the local memory 110 of the assistant device 102. The memory may also include instructions to process the audio inputs.

In a situation where multiple ones of the devices 102 receive the same audio command, the processor 125 may perform signal processing to select one signal with the highest quality signal from a plurality of microphone output signals received from the microphones 104 of the devices 102. That is, the processor 125 may select which microphone 104 provided the 'cleanest' signal to process. The processor 125 may make this determination by comparing the amplitude, frequency content, and phase of the microphone output signals received from the microphones 104.

In one example, the processor 125 may select the microphone output signal having the best spatial diversity, and/or the least amount of reverberant energy. The processor 125 may perform autocorrelation functions on all of the microphone output signals. Once the signals are autocorrelated, the processing circuit may determine the signal with the least amount energy away from an average peak of the correlated signals. This signal may be selected for input and for further processing. The processor 125 may also analyze the autocorrelation envelope around the autocorrelation peak. The signal with the narrowest width between envelope peaks may be considered the more ideal signal. The processor 125 may also compare the slopes of the signal peaks of each signal, and select the signal with the highest slope of a falling side (e.g., the negative side) of the peak.

In another example, the room impulse response (RIR) of each signal may be used to select the highest quality signal. In this example, the signal having the shortest RIR would have the highest quality. Further, the signal having the least energy outside of the main peak of the RIR may be selected. The processor 125 may discard the remaining signal following the peak as these tailing signals may be considered reverberant energy. As the RIR increases in complexity (i.e., more reflections), the autocorrelation may widen.

By selecting the microphone output signal with the highest quality, a more accurate response to the user command may be achieved. Furthermore, but only processing one of the microphone output signals, duplicative processing is avoided.

As illustrated in FIG. 2, a user 113 may be located within the area 152. The user 113 may speak an audible command that makes up the audio input. The microphone 104 of each of the assistant devices 102 may receive the spoken command. Each microphone 104 may then relay the audio input to the system controller 115. Typically, as a sound source, such as the user, and a receiver, such as the microphone 104 get farther apart, the quality of the audio signal decreases. For example, the strength of the signal is reduced in that the sound wave is reduced due to spherical spreading, also referred to as $R^2$ loss or 20 log R loss. Further, high frequencies may be attenuated more than low frequencies due to the temperature and humidity of the air. The signal may also incur a propagation delay, as well as appreciate reflections and echoes caused by obstructions within the area 152, such as walls, objects, etc. This is referred to as reverberation. Each of these distortions may cause the above referenced methods of determining the highest quality signal problematic.

Figure 3:
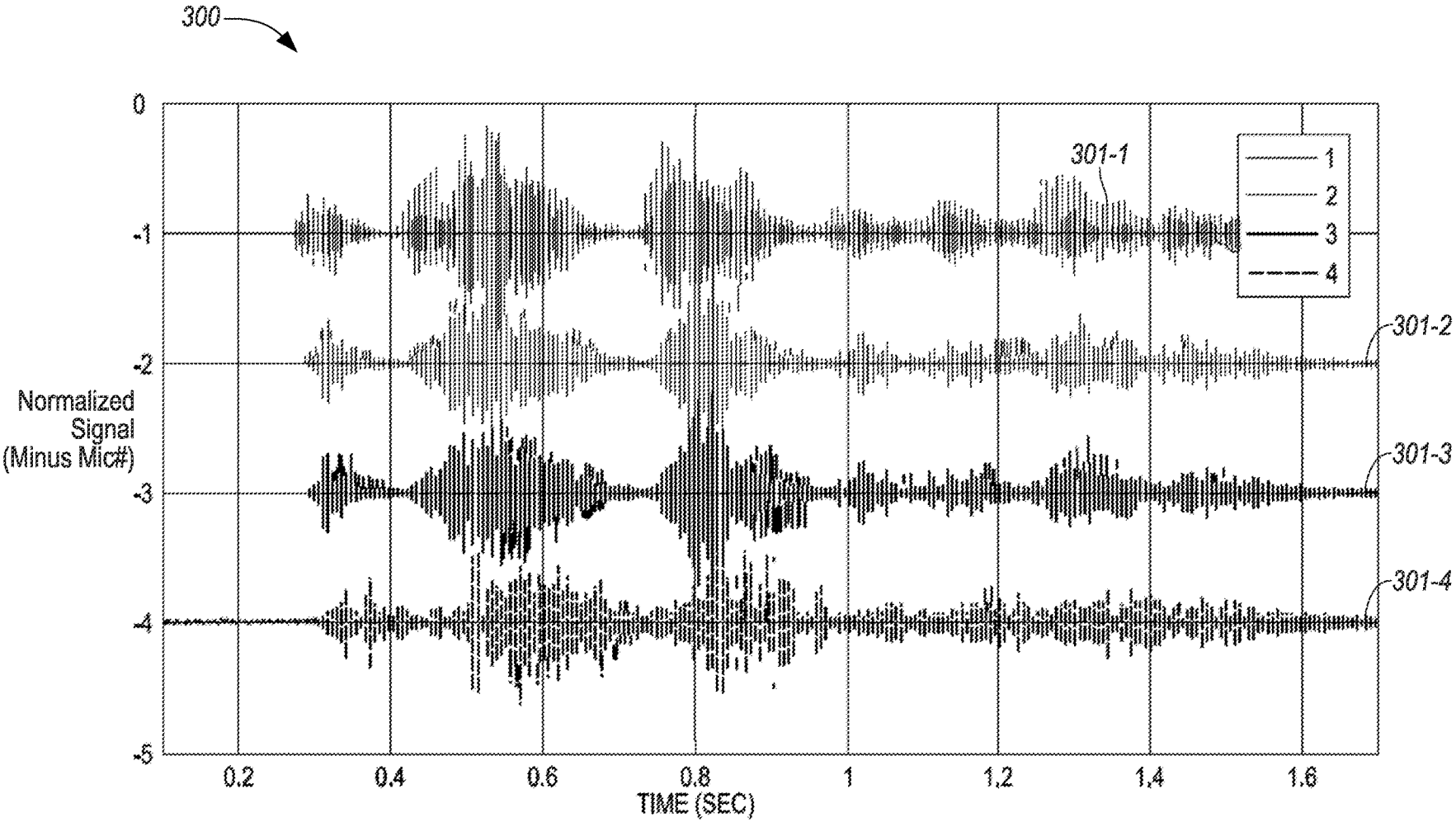
FIG. 3 illustrates an example graph of a plurality of microphone output signals as received by the multiple microphones, each at a varying distance from the user.

FIG. 3 illustrates an example graph of a plurality of microphone output signals comprising one sentence of speech as received by the multiple microphones 104, each at a varying distance from the user 113. The first signal 301-1 corresponds to the microphone output signal received from the first microphone 102-1. The second signal 301-2 corresponds to the microphone output signal received from the second microphone 102-2. The third signal 301-3 corresponds to the microphone output signal received from the third microphone 102-3. The fourth signal 301-4 corresponds to the microphone output signal received from the first microphone 102-4.

In this example, the user 113 is in closest proximity to the first device 102-1, with each sequential device being farther from the user 113. In this example, the first device 102-1 may be less than 8 feet from the user 113, the second device 102-2 may be approximately 16 feet from the user, the third device 102-3 may be approximately 24 feet from the user 113, and the fourth device may be approximately 36 feet from the user, as well as being around a corner and inside a room, out of the line of sight from the user 113. In the graph, the signals may have been normalized for energy via an automatic gain control (AGC). As illustrated in FIG. 3, for each progressively farther device 102, the signal is received later, with the fourth and farthest device receiving the signal about 0.03 seconds late.

Further, the first signal 301-1 has the steepest slope during the time period of 0.4-0.6 s as compared to the other signals 301 in similar time periods. The first signal 301-1 also has the steepest slope within the 1.2-1.4 s time period as compared to the other signals 301. Because the first signal 301-1 is identified as having the steepest slope, the first signal 301-1 may therefore be identified as having the best quality, compared to the other signals 301. Furthermore, the first signal 301-1 may also have the greatest energy at its peak, as illustrated at approximately 0.55 s. To the contrary, the fourth signal 301-4 has the flattest, or lowest slope, and thus having the greatest reverberant energy. The fourth signal 301-4 would not be selected as the highest quality signal over any of the other signals 301.

Further, the processor 125 may infer the signals' reverberation via autocorrelation to determine the signal with the highest quality. Autocorrelation may look for repetitions within signal. Echoes and reverberation are effectively repetitions in the sound wave. The energy spread in an autocorrelation vector, i.e., the deviation from the center peak, indicates the amount of reverberation and also the amount of noise of a signal. Autocorrelation may refer to signal processing, where $R(I)=\text{sum}\{y(n)*y(n-1)\}$. The processor 125 may autocorrelated each of the audio inputs and determine the energy spread in the microphone output signals. The energy spread may be the distance between two energy peaks. The processor 125 may determine the signal with the least energy in the spread of the energy peak. The signal with the least energy may be selected as the highest quality audio input. The processor 125 may also compare the signals in time and the signal with the least delay from the peak energy may be selected for further processing.

Other signal processing such as RIR and spectral subtraction, may also be used. The RIR may be measured by each of the microphones 104. The RIR may then be inverted, correlated to a signal received at any of the plurality of microphones, and subtracted therefrom.

Dereverberation or identification of the best quality signal using spectral subtraction removes reverberant speech energy by cancelling the energy of preceding phonemes in the current frame. The spectral subtraction may be used to reduce the reverberation from the environment in which the microphones are sensing the sound signal. The spectral subtraction may also be enhanced by identifying segments of an audio signal as pertaining to certain noises. For example, these segments may be identified as including speech, noise, or other acoustic signals. In periods where activity is not detected, the segment may be considered to be noise. The noise spectrum may then be estimated from such identified pure noise segments. A replica of the noise spectrum is then subtracted from the signal.

The processing of each microphone output signal may be done by the system controller 115. In this example, the system controller 115 receives the microphone output signals from each of the assistant devices 102. Additionally or alternatively, the processing of the microphone output signals may be done by the respective device controller 118 of the personal assistant device 102 which acquired the audio input. Further, each assistant device 102 may process the other microphone output signals generated by microphones 104 of the other personal assistant devices. The respective device controller 118 may determine whether the signal provided by that assistant device 102 is that of the highest quality as compared to the signals generated by the other assistant devices 102. If so, then the device controller 118 instructs the wireless transceiver 124 to transmit the microphone output signal to the system controller 115 for processing. If not, then the device controller 118 does not instruct the microphone output signal to be sent to the system controller 115. Instead, the assistant device 102 that provided the highest quality signal transmits the output signal to the system controller 115 for further processing and carrying out of the command issued by the audio input. Thus, in this example, only one microphone output signal is received at the system controller 115.

Figure 4:
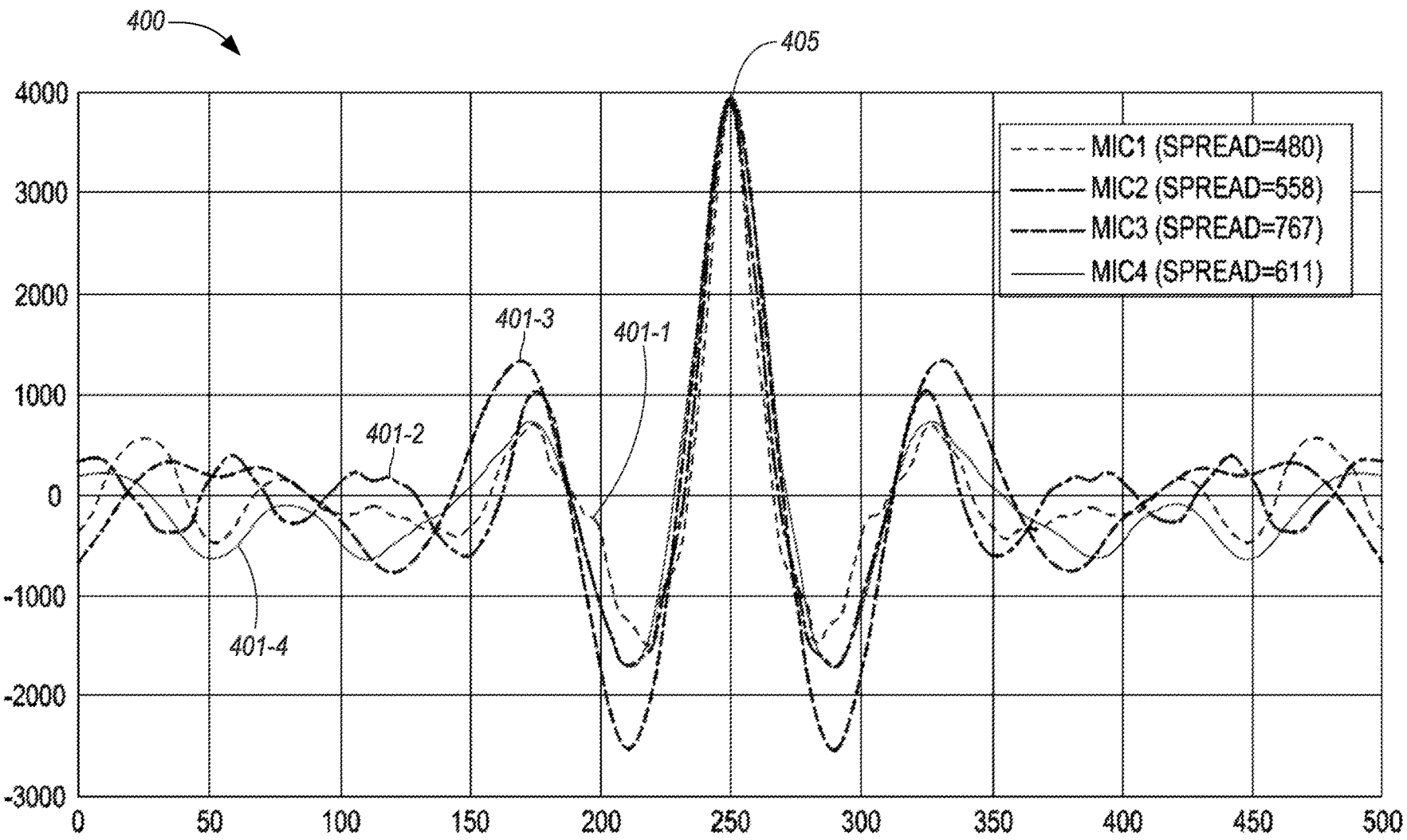
FIG. 4 illustrates an example graph of each of the autocorrelated microphone output signals.

FIG. 4 illustrates a graph 400 of each of the autocorrelated microphone output signals. The graph illustrates a 500-point autocorrelation of each signals, including an autocorrelated first signal 401-1, autocorrelated second signal 401-2, autocorrelated third signal 401-3, and autocorrelated fourth signal 401-4. Each of the autocorrelated signals were normalized for energy such that their autocorrelated peaks 405 all have the same values. The values in the legend show an average energy across the spread. As illustrated via FIG. 4, the first signal 401-1 has the steepest slope. Further, the first signal 401-1 has a peak closest to the highest peak. For each progressively farther microphone 104, there is more energy that lags away from the autocorrelation peak 405. This may be due to reflections of the audio signals. Thus, the first signal 401-1 has a lower reverberant energy than the remaining signals. The second signal 401-2 has a lower reverberant energy than the third and fourth signals 401-3, 404-4.

Figure 5:
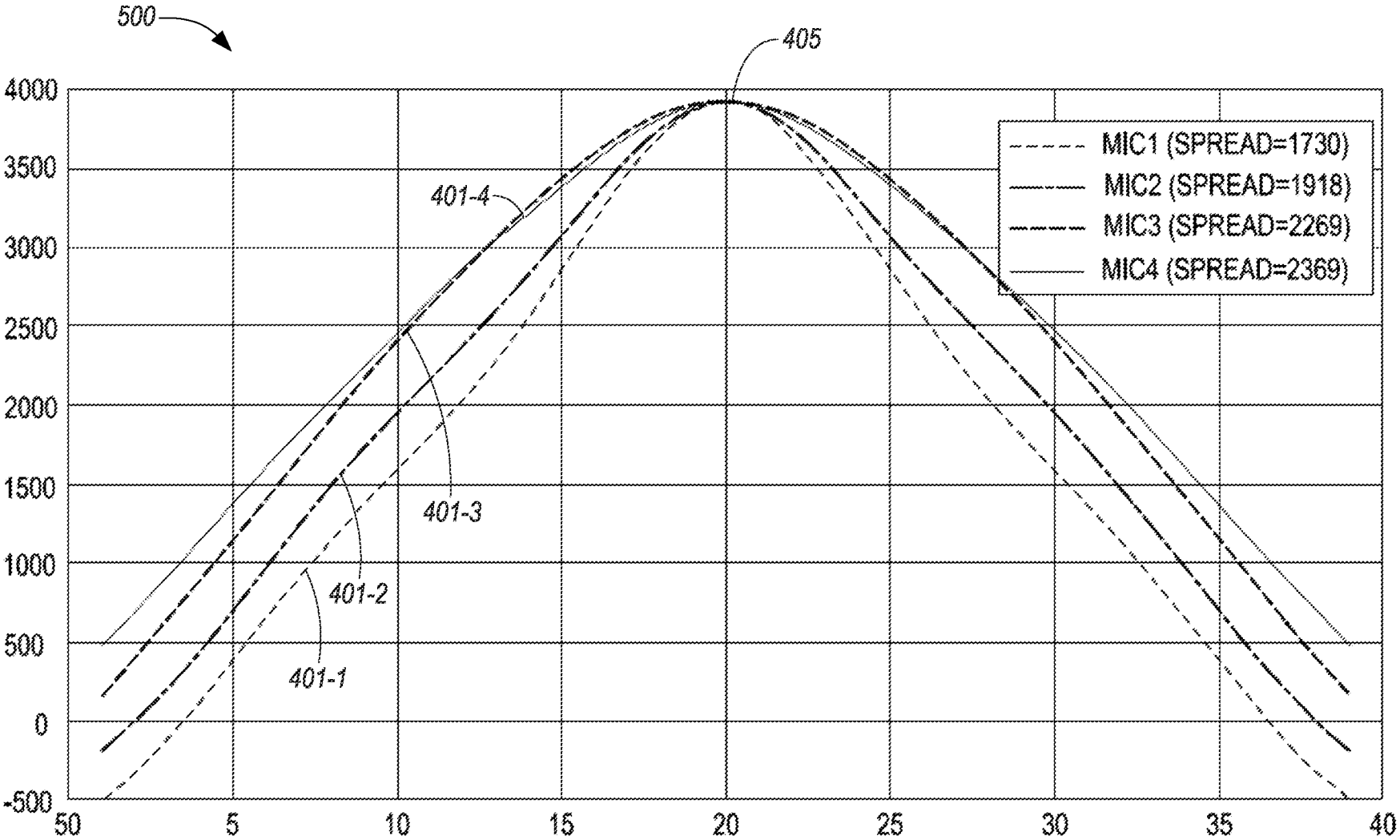
FIG. 5 illustrates an example graph of the autocorrelated signals of FIG. 4.

FIG. 5 illustrates a graph 500 of the autocorrelated signals of FIG. 4 with a 40 point autocorrelation. Due to the lesser point construction (e.g., 40 vs. 500), the graph 500 is computationally more efficient than graph 400. The graph 500 includes the autocorrelated first signal 401-1, autocorrelated second signal 401-2, autocorrelated third signal 401-3, and autocorrelated fourth signal 401-4. For each of the progressively farther microphones, the autocorrelation gets wider around the peak 405. That is, the microphone output signal with the narrowest energy spread about the average peak 405 may have the lowest reverberation. Despite the high variability of typical speech signals, and the decrease in signal-to-noise ratio with farther microphones, the spread around the peaks is still smooth, monotonically decreasing, and with obvious separation between each microphone. By using the example sample points 20, 30, and 40, the computational costs are vastly reduced, as only a 2 or 3 point correlation is required.

As shown in FIG. 5, the first signal 401-1 associated with the microphone 104 of the first assistant device 102-1 has the lowest energy spread at 1730. This microphone 401-1 is the closest to the user 113. The second signal 401-2 has a spread of 1918. The first signal 401-3 has a spread of 2269, and the fourth signal 401-4 has a spread of 2369. These spreads are of example signals and will vary with each received audio input.

Although in this example, the closest microphone 104 has the least amount of spread, this may not always be the case. The local reverberation may be larger than another microphone that is farther away from the user 113. This may be the case due to reflections of objection nearby, etc.

Figure 6:
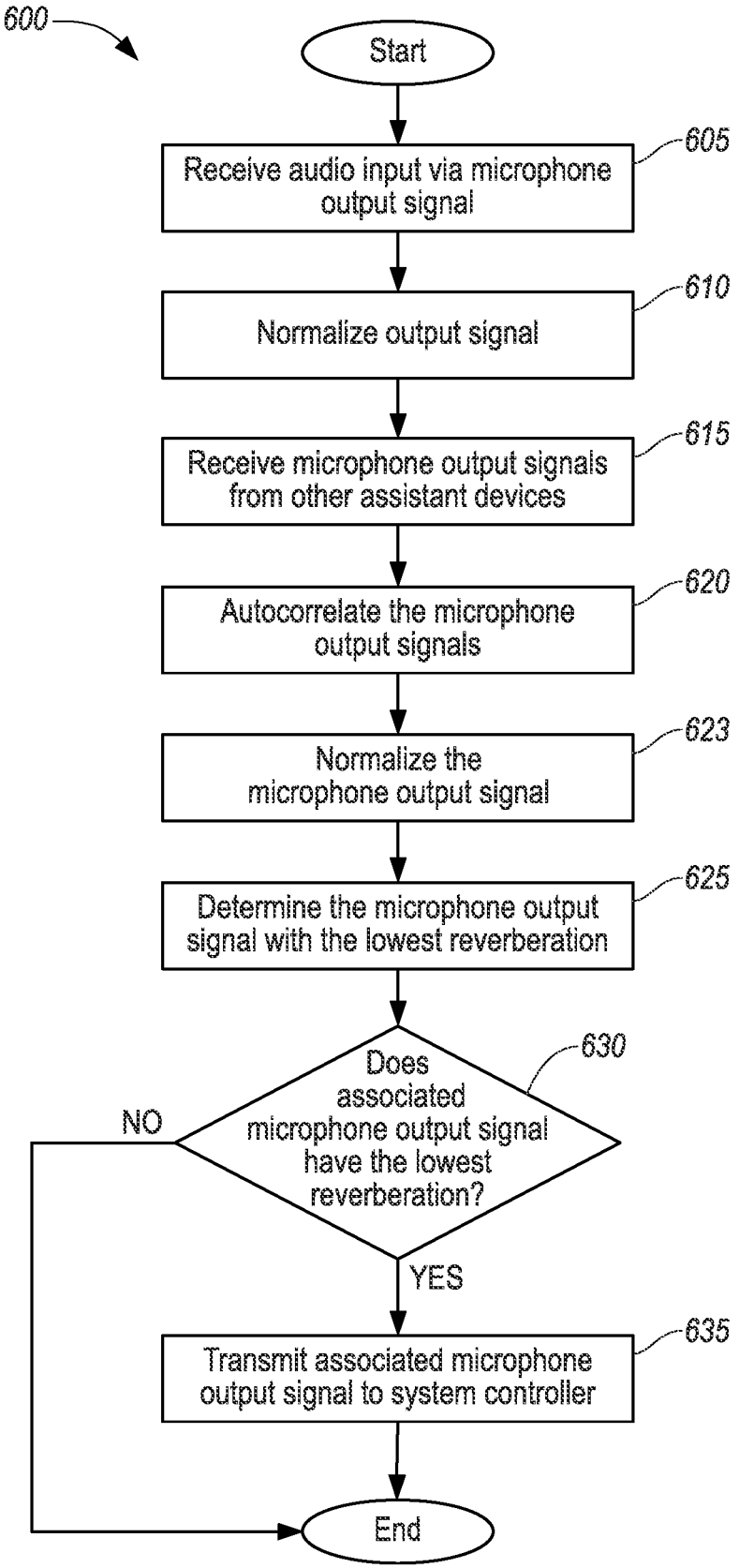
FIG. 6 illustrates an example process of the system of FIG. 2.

FIG. 6 illustrates an example process 600 for the system 150. The process 600 may begin at block 605 where the processor 120 of more than one assistant device may receive an audio command via an audio input at the respective microphone 104 of the assistant device 102. The audio command may be a user-spoken command for controlling one or more device, such as "turn on the lights," or "play music."

At block 610, the processor 120 may normalize the audio input in order to adjust the energy peaks of the audio input.

At block 615, the processor 120 may receive, via the wireless transceiver 124 the normalized signals (i.e., the microphone output signals) from the other personal assistant devices 102. Conversely, the processor 120 may also transmit the microphone output signal to the other personal assistant devices 102.

At block 620, the processor 120 may autocorrelate the microphone output signals. That is, the processor 120 may compare each microphone output signal from each of the assistant device 102, including the present assistant device.

At block 623, the processor 120 may normalize the microphone output signals.

At block 625, the processor 120 may determine which of the microphone output signals has the highest quality. The signal with the highest quality may be the signal with the lowest reverberation. The reverberation of the signals may be determined using the methods described above, such as RIR.

At block 630, the processor 120 determines whether the microphone output signal received at the associated microphone 104 of the present device 102 has the lowest reverberation compared to the other received microphone output signals. If so, the process 600 proceeds to block 635. If not, then another device 102 may recognize their respective signal as that having the lowest reverberation and the process 600 ends.

At block 635, the processor 120 may instruct the wireless transceiver 124 to transmit the microphone output signal received at the device 102 to the system controller 115. The system controller 115 may then in turn respond to the audio command provided by the user.

The process 600 may then end.

By only transmitting the signal with the highest quality to the system controller 115, duplicative processing of the audio command is avoided. The signal with the highest quality, which may lead to better comprehension of the audio command provided by the user 113, may be used to respond to the command.

The process 600 is an example process 600 where each assistant device 102 determines whether that device 102 received the highest quality signal an if so, transmits that signal to the system controller 115. Additionally or alternatively, the processor 125 of the server controller 115 may receive each of the microphone output signals and the processor 125 may then select which of the received signals have the highest quality.

While the systems and methods above are described as being performed by the processor 120 of a personal assistant device 102, or a processor 125 of a system controller 115, the processes may be carried about by another device, or within a cloud computing system. The processor may not necessarily be located within the room with a companion device, and may be remote of the are in general.

Accordingly, companion devices that may be controlled via virtual assistant devices may be easily commanded by users not familiar with the specific device long-names associates with the companion devices. Short-cut names such as "lights" may be enough to control lights in near proximity to the user, e.g., in the same room as the user. Once the user's location is determined, the personal assistant device may react to user commands to efficiently, easily, and accurately control companion device.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A personal assistant device, comprising:

a microphone configured to receive an audio command from a user;

a processor configured to:

receive a microphone output signal from the microphone based on the received audio command;

receive at least one other microphone output signal from another personal assistant device;

autocorrelate the microphone output signals;

determine a reverberation of each of the microphone output signals;

determine whether the microphone output signal from the microphone has a lower reverberation than the at least one other microphone output signal; and transmit the microphone output signal to at least one other processor for processing of the audio command in response to the microphone output signal having a lower reverberation than the at least one other microphone output signal.

2. The device of claim 1, wherein the reverberation is determined based at least in part on an energy spread of the autocorrelated signals.

3. The device of claim 2, wherein the reverberation is determined based at least in part on a room impulse response (RIR) of the microphone output signals.

4. The device of claim 2, wherein the processor is further configured to normalize the microphone output signal after the autocorrelation.

5. The device of claim 4, wherein the processor is further configured to identify an average peak of the correlated microphone output signals.

6. The device of claim 5, wherein the reverberation is determined based at least in part on an energy width of the autocorrelated signals with respect to the average peak.

7. The device of claim 5, wherein the autocorrelated signal with the narrowest energy spread about the average peak has the lowest reverberation.

8. A personal assistant device system, comprising:

a plurality of personal assistant devices, each including a microphone configured to receive an audible user command;

a processor configured to:

receive at least one microphone output signal based on the user command from each of the personal assistant devices, autocorrelate the microphone output signals;

determine a reverberation of each of the microphone output signals; and determine which of the microphone output signals has the lowest reverberation; and process the microphone output signal having the lowest reverberation.

9. The device of claim 8, wherein the reverberation is determined based at least in part on an energy spread of the microphone output signals.

10. The device of claim 9, wherein the reverberation is determined based at least in part on a room impulse response (RIR) of the microphone output signals.

11. The device of claim 8, wherein the processor is further configured to normalize the microphone output signal after the autocorrelation.

12. The device of claim 8, wherein the processor is further configured to identify an average peak of the correlated microphone output signals.

13. The device of claim 12, wherein the reverberation is determined based at least in part on an energy width of the autocorrelated signals with respect to the average peak.

14. The device of claim 12, wherein the autocorrelated signal with the narrowest energy spread about the average peak has the lowest reverberation.

15. A method comprising:

receiving a microphone output signal from a microphone of a personal assistant device based on a received audio command;

receiving at least one other microphone output signal from another personal assistant device;

autocorrelating the microphone output signals;

determining a reverberation of each of the microphone output signals; and determining whether the microphone output signal from the microphone has a lower reverberation than the at least one other microphone output signal; and transmitting the microphone output signal to at least one other processor for processing of the audio command in response to the microphone output signal having a lower reverberation than the at least one other microphone output signal.

16. The method of claim 15, wherein the reverberation is determined based at least in part on an energy spread of the autocorrelated signals.

17. The method of claim 15, further comprising normalizing the microphone output signals after the autocorrelation.

18. The method of claim 15, wherein the reverberation is determined based at least in part on a room impulse response (RIR) of the microphone output signals.

19. The method of claim 15, further comprising identifying an average peak of the correlated microphone output signals.

20. The method of claim 19, wherein the reverberation is determined based at least in part on an energy width of the autocorrelated signals with respect to the average peak.

* * * * *